US011982445B2

(12) United States Patent
Seeley et al.

(10) Patent No.: US 11,982,445 B2
(45) Date of Patent: May 14, 2024

(54) BURNER ELEMENT FABRICATION USING INJECTION MOULDING AND CONSEQUENT SINTERING

(71) Applicant: Edwards Limited, Burgess Hill (GB)

(72) Inventors: Andrew James Seeley, Clevedon (GB); Duncan Michael Price, Clevedon (GB)

(73) Assignee: Edwards Limited, Burgess Hill (GB)

( * ) Notice: Subject to any disclaimer, the term of this patent is extended or adjusted under 35 U.S.C. 154(b) by 97 days.

(21) Appl. No.: 17/779,361

(22) PCT Filed: Nov. 24, 2020

(86) PCT No.: PCT/GB2020/052987

§ 371 (c)(1),
(2) Date: May 24, 2022

(87) PCT Pub. No.: WO2021/105660

PCT Pub. Date: Jun. 3, 2021

(65) Prior Publication Data

US 2023/0001478 A1 Jan. 5, 2023

(30) Foreign Application Priority Data

Nov. 25, 2019 (GB) ..... 1917144

(51) Int. Cl.
*F23G 7/06* (2006.01)
*B22F 1/12* (2022.01)
(Continued)

(52) U.S. Cl.
CPC ..... *F23G 7/065* (2013.01); *B22F 1/12* (2022.01); *B22F 3/002* (2013.01); *B22F 3/1025* (2013.01);
(Continued)

(58) Field of Classification Search
CPC ..... F23G 7/065; F23G 2209/142; B22F 1/12; B22F 3/002; B22F 3/1025; B22F 3/1103;
(Continued)

(56) References Cited

U.S. PATENT DOCUMENTS

2002/0195188 A1* 12/2002 Kuhstoss ..... B22F 3/1121 156/89.16
2005/0161861 A1* 7/2005 Lammers ..... B29B 11/16 425/375
(Continued)

FOREIGN PATENT DOCUMENTS

DE 19750964 A1 * 5/1999 ..... B22F 1/0059
DE 19750964 A1 5/1999
(Continued)

OTHER PUBLICATIONS

British Examination Report dated May 14, 2020 and Search Report dated May 13, 2020 for corresponding British Application No. GB1917144.6, 7 pages.
(Continued)

*Primary Examiner* — Samir Shah
*Assistant Examiner* — Ricardo D Morales
(74) *Attorney, Agent, or Firm* — Theodore M. Magee; Westman, Champlin & Koehler, P.A.

(57) ABSTRACT

A method of fabricating a burner element for an abatement apparatus is disclosed. The method comprises: injection moulding a charge comprising metal particles and a flow compound into a mould defining the burner element to produce a moulded burner element; and sintering the moulded burner element. In this way, injection moulding is used to produce the burner element, which provides far more flexibility regarding the design and properties of the burner
(Continued)

element and avoids the necessity of incorporating a perforated support into the burner element. This allows burner elements of more intricate design to be produced, as well as burner elements which are thinner than those produced using existing techniques, which increases the volume of a combustion chamber defined by that burner element for any external burner element size, which in turn increases the amount of effluent gas that can be treated for any burner size.

17 Claims, 4 Drawing Sheets

(51) Int. Cl.

| | |
|---|---|
| ***B22F 3/00*** | (2021.01) |
| ***B22F 3/10*** | (2006.01) |
| ***B22F 3/11*** | (2006.01) |
| ***B22F 3/22*** | (2006.01) |
| ***B22F 5/10*** | (2006.01) |

(52) U.S. Cl.
CPC ..... *B22F 3/1103* (2013.01); *B22F 3/1121* (2013.01); *B22F 3/225* (2013.01); *B22F 5/10* (2013.01); *B22F 2998/10* (2013.01); *B22F 2999/00* (2013.01)

(58) Field of Classification Search
CPC ..... B22F 3/1121; B22F 3/225; B22F 5/10; B22F 2998/10; B22F 2999/00; B22F 5/00; F23D 14/46; F23D 2213/00
See application file for complete search history.

(56) References Cited

U.S. PATENT DOCUMENTS

| | | | |
|---|---|---|---|
| 2018/0073732 | A1 | 3/2018 | Seeley |
| 2019/0283138 | A1 | 9/2019 | Sheng et al. |

FOREIGN PATENT DOCUMENTS

| | | | |
|---|---|---|---|
| DE | 102004016333 | A1 | 10/2005 |
| JP | H01123009 | A | 5/1989 |
| WO | 2016083776 | A1 | 6/2016 |
| WO | 2017175471 | A1 | 10/2017 |

OTHER PUBLICATIONS

PCT Notification of Transmittal of the International Preliminary Report on Patentability dated May 12, 2021, International Search Report dated May 12, 2021 and Written Opinion of the International Searching Authority dated May 12, 2021 for corresponding PCT application Serial No. PCT/GB2020/052987, 11 pages.
EPO communication dated Jun. 1, 2023 for corresponding European application Serial No. EP20815912.9, 5 pages.

* cited by examiner

BURNER ELEMENT FABRICATION USING INJECTION MOULDING AND CONSEQUENT SINTERING

CROSS-REFERENCE TO RELATED APPLICATION

This application is a Section 371 National Stage Application of International Application No. PCT/GB2020/052987, filed Nov. 24, 2020, and published as WO 2021/105660 A1 on Jun. 3, 2021, the content of which is hereby incorporated by reference in its entirety and which claims priority of British Application No. 1917144.6, filed Nov. 25, 2019.

FIELD

The present invention relates to a method of fabricating a burner element for an abatement apparatus.

BACKGROUND

Abatement apparatus and in particular radiant burners are known and are typically used for treating an effluent gas stream from a manufacturing processing tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion or radiant heat to remove the PFCs and other compounds from the effluent gas stream. Typically, the effluent gas stream is a nitrogen stream containing PFCs and other compounds. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner to affect flameless combustion at the exit surface, with the amount of air passing through the foraminous burner being sufficient to consume not only the fuel gas supply to the burner, but also all the combustibles in the gas stream mixture injected into the combustion chamber. Electrical-powered apparatus use heat generated electrically to achieve the same effect.

Although techniques exist for fabricating burner elements, they each have their own shortcomings. Accordingly, it is desired to provide an improved technique for fabricating a burner element.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided a method of fabricating a burner element for an abatement apparatus, comprising: injection moulding a charge comprising metal particles and a flow compound into a mould defining the burner element to produce a moulded burner element; and sintering the moulded burner element. The first aspect recognizes that a problem with existing burner element fabrication techniques is that a perforated liner is required onto which metal fibres in a fluid suspension are accumulated through the application of a negative pressure and resultant fluid flow through the perforated liner. This results in requiring a thicker than desired accumulation of material forming the burner element to ensure that any local anomalies in the accumulation of the burner element material on the perforated support are compensated by the macro structure. Furthermore, using this approach, the liner necessarily becomes an integral part of the burner element and the design freedom relating to the detailed structure and properties of the burner element fabricated in this way is constrained.

Accordingly, a method is provided. The method may be for fabricating a burner element or burner structure. The burner element may be for an abatement apparatus. The method may comprise injection moulding a charge into a mould. The charge may comprise metal particles such as fibres, strips, lengths or pieces, or powder together with a flow compound. The mould may define a void which shaped to match the shape of the burner element. The charge when moulded in the mould may produce a moulded burner element. The method may comprise sintering the moulded burner element. In this way, injection moulding is used to produce the burner element, which provides far more flexibility regarding the design and properties of the burner element and avoids the necessity of incorporating a perforated support into the burner element. This allows burner elements of more intricate design to be produced, as well as burner elements which are thinner than those produced using existing techniques, which increases the volume of a combustion chamber defined by that burner element for any external burner element size, which in turn increases the amount of effluent gas that can be treated for any burner size.

The method may comprise debinding the moulded burner element to allow the flow compound to escape from the moulded burner element prior to sintering. Accordingly, the flow compound, which is used to assist the metal fibre or powder flow within the mould, may be removed before sintering occurs. Alternatively, the debinding may occur as part of the sintering.

The charge may comprise a porogen. Accordingly, the charge injected into the mould may also be provided with particles used to make pores in the moulded structure. The size and amount of porogen may be selected to provide for a particular desired porosity.

The method may comprise debinding the moulded burner element to allow the porogen to escape from the moulded burner element prior to sintering. Accordingly, the porogen may be removed from the moulded burner element before sintering occurs. Alternatively, the debinding may occur as part of the sintering.

The charge may comprise around 5% to 10% by volume of the flow compound, around 15% to 20% by volume of the metal fibres with the balance being the porogen. A suitable amount of the flow compound may be provided to enable the metal fibres to flow sufficiently within the mould. The ratio of metal fibres to porogen may then selected to provide the required porosity.

The charge may comprise the porogen selected to have a melting temperature which is higher than that of the flow compound. Accordingly, the flow compound may typically melt at a lower temperature than the porogen, enabling the flow compound to be removed while the metal fibres and the porogen remain.

The charge may comprise the porogen selected to have a melting temperature which is less than a sintering temperature of the metal fibres. Accordingly, the porogen may typically melt before the sintering of the metal fibres takes place.

The charge may comprise metal powder. Accordingly, a mixture of metal powder and metal fibres may be included in the charge, in order to provide a burner element with the required properties.

The injection moulding may comprise multi-shot injection moulding comprising injection moulding one charge having a metal powder and one flow compound and another charge having the metal fibres, the flow compound and the porogen. Accordingly, injection moulding with more than one shot may occur where multiple, typically different mixture (but not exclusively) charges are injected into the mould, which may be reconfigured between charges. This enables composite structures to be produced, which provides for additional design flexibility and for improved properties of the burner element. For example, one shot may utilize a metal powder and a flow compound. This shot will typically provide a non-porous structure to form usually a structural part of the burner element, such as an outer housing, which may help define a plenum, an endplate or intermediate structural components. Another charge may have metal fibres together with the flow compound and porogen, in order to provide a porous structure which may, for example, provide a burning surface having the required properties.

The one charge may comprise around 5% to 10% by volume of the flow compound with the balance being the metal powder. Accordingly, a suitable amount of flow compound may be provided to enable the metal powder to flow into the mould.

Each shot or charge may have differing amounts of porogen to provide differing porosities for different structures forming the burner element.

The differing amounts of porogen may be provided by different shots, each of which has a different ratio of porogen to metal particles and/or by varying the ratio of porogen to metal particles within a shot.

The metal particles may comprise metal fibres.

The metal powder and the metal fibres may have an overlapping sintering temperature range. This enables both the metal powder and the metal fibres to be sintered together in a single sintering operation.

The injection moulding of one of the first charge and the second charge may generate surface features shaped to enhance mechanical bonding between the first charge and the second charge. Accordingly, the moulded structure produced by the first charge and/or the second charge may define or create features which facilitate the connection or fixing between the two structures.

The first charge and the second charge may be at least partially separated by a void material defining a void between the first charge and the second charge. Accordingly, an intermediate or temporary void material may be utilized, typically with a restructuring or reconfiguration of the mould to facilitate its incorporation, in order to separate or create a cavity or plenum between the structures created by the first charge and the second charge.

The method may comprise removing the void material prior to sintering. Accordingly, once the void material has served its purpose during the injection moulding process it may be removed before sintering takes place.

At least one surface of the mould may comprise a removable perforated layer which forms part of the moulded burner element. Accordingly, the mould itself may be provided with a removable perforated layer which forms part of the mould into which the charge is injected. The perforated layer may then be removed from the mould, together with the attached charge, together forming the moulded burner element.

At least one of the metal fibres and the metal powder may comprise FeCr alloy and/or stainless steel. It will be appreciated that a variety of suitable metal materials may be incorporated to form the moulded burner element.

The flow compound may comprise an organic and/or a polymeric compound. It will be appreciated that a variety of suitable flow compounds may be provided to facilitate the injection moulding of the metal into the mould.

The porogen may comprise at glass beads and/or an organic compound and/or a polymeric compound. It will be appreciated that a variety of different suitable porogens may be utilized in order to provide the appropriate porosity.

The porogen may comprise a material which thermally decomposes and/or which may be removed using a solvent. Such porogens may comprise a polymer and/or a water-soluble material.

The porogen may have a particle size of between around 0.5 mm to 2 mm, and typically around 1 mm.

The porogen may be provided in a ratio of between around 75% to 95% porogen with the balance being the metal particles.

The metal fibres may have a diameter of between around 0.05 mm to 0.25 mm, and typically around 0.1 mm.

The metal powder may have a particle size of around 0.0005 mm to 0.0025 mm, and typically around 0.001 mm.

The features set out above may be combined with each other and with the aspects. Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in more detail, first an overview will be provided. Embodiments provide an arrangement for manufacturing one or more components or elements of an abatement apparatus produced by metal injection moulding. Embodiments may produce individual porous or non-porous elements of the abatement apparatus. Typically, the component comprise a one-piece burner element formed at least partly from a porous sintered metal part which is typically fused with a non-porous housing, with a hollow plenum space between the porous and non-porous structures. This approach enables complex structures to be produced, which can have thinner porous sintered metal parts than are possible using existing techniques, which in turn provides for an increased volume available for treating effluent gases per unit volume of abatement apparatus, since the burner element itself occupies less space. The burner element may be made from a single mixture of materials or may be made as a composite structure from different mixtures of materials. Typically, the mixtures or charges are made from a metal material formed into fibres, strands, shards, lengths, pieces or powder, together with a flow compound to facilitate the flow of the metal into a mould. The porosity of the resultant moulded burner element can be improved through the addition of a suitable porogen. Also, the porosity of portions of the elements can be varied within the parts by varying the amount and/or size of the porogen in those elements. For example, one portion can have no porogen to provide a non-porous body (such as a portion of the housing, such as a mount or a plate) with other portions having different porosities (such as the burner sleeve). Also, some portions can be have discrete or variable (graded) porosities within those portions (such as the burner sleeve having differing porosities at different, typically axial, positions along the burner sleeve) by varying the amount of porogen present in those portions. The porogen can have a particle size of between around 0.5 mm to 2 mm, and typically around 1 mm. The porogen can be provided in a ratio of between around 75% to 95% porogen with the balance being the metal particles. The metal fibres can have a diameter of between around 0.05 mm to 0.25 mm, and typically around 0.1 mm. The metal powder may have a particle size of around 0.0005 mm to 0.0025 mm, and typically around 0.001 mm.

Main Fabrication Steps

Figure 1:
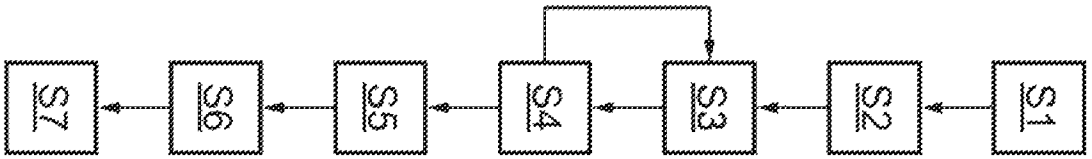
FIG. 1 is a flowchart illustrating the main processing steps performed when fabricating a burner element.

FIG. 1 is a flowchart illustrating the main processing steps performed when fabricating a burner element 130. FIGS. 2A to 2H illustrate schematically the configuration of an injection moulding apparatus during such fabrication.

At step S1, the various charges to be used in the preparation of the burner element are prepared. In this embodiment, the burner element comprises a foraminous burner sleeve 10 (which is cylindrical in shape, but can be of any required shape that is mouldable) concentrically surrounded by an outer housing 20 having an integral endplate 30 (which is cylindrical in shape, but can be of any required shape that is mouldable). In this embodiment, a cylindrical plenum 40 is formed between the outer housing 20 and the foraminous burner sleeve 10, into which fuel will be provided during operation of the abatement apparatus, which passes through the foraminous burner sleeve 10 to effect combustion within a combustion chamber 50 into which an effluent stream to be treated (typically together with an oxidant) is provided. Typically, an end annular ring (not shown) bridges between the burner sleeve 10 and the outer housing 20 to enclose the plenum 40. It will be appreciated that in other embodiments, electrically-heated burner elements may be fabricated using a similar technique.

Accordingly, at step S1, a charge for forming the outer housing 20 and a charge for forming the burner sleeve 10 is prepared. Typically, the charge for the outer housing 20 is a mixture of a metal powder and a flow compound. Typically, the charge for the burner sleeve 10 is a mixture of metal fibres (possibly also with a metal powder), a flow compound and a porogen.

Figure 2A:
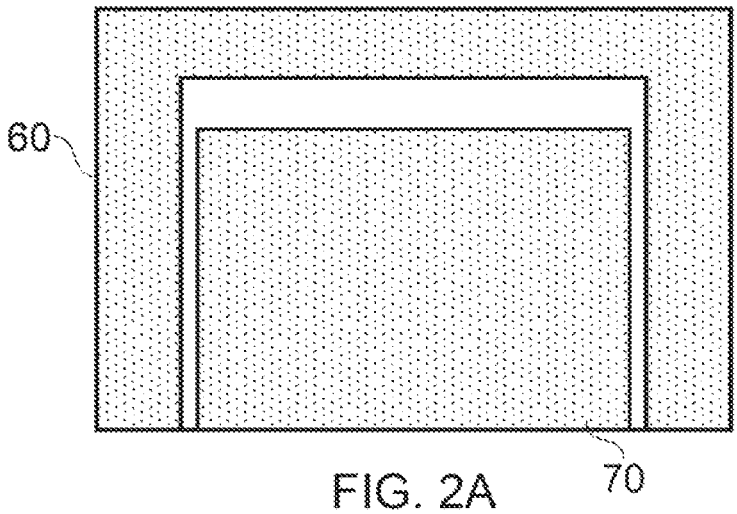
FIGS. 2A to 2H illustrate schematically the configuration of an injection moulding apparatus when fabricating the burner element.

At step S2, the moulds are prepared. In this case, an outer mould 60 and an inner core 70 are co-located to define an outer housing void 80, as shown in FIG. 2A. The inner core 70 may be provided with undulations on its surface (not shown) at the location where the foraminous burner sleeve 10 will be moulded to enhance mechanical coupling between the outer housing 20 and the foraminous burner sleeve 10.

Figure 2B:
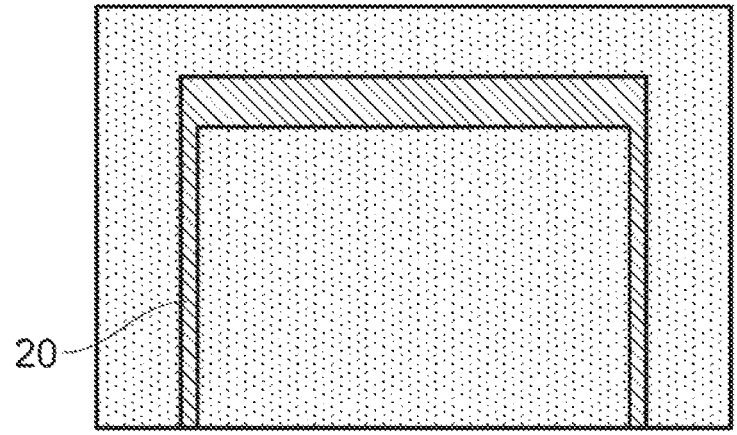

At step S3, a charge is injected. In this example, the outer housing charge is injected to form the outer housing 20, as shown in FIG. 2B.

Figure 2C:
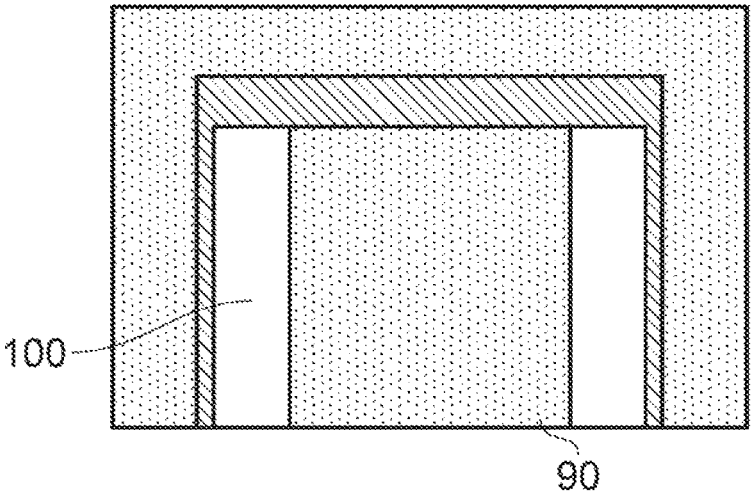

At step S4, the mould is reconfigured and processing returns to step S3. As shown in FIG. 2C, the first core 70 is removed and a second core 90 is inserted in its place. The second core 90 has a smaller diameter than the first core 70, and so defines a plenum void 100.

Figure 2D:
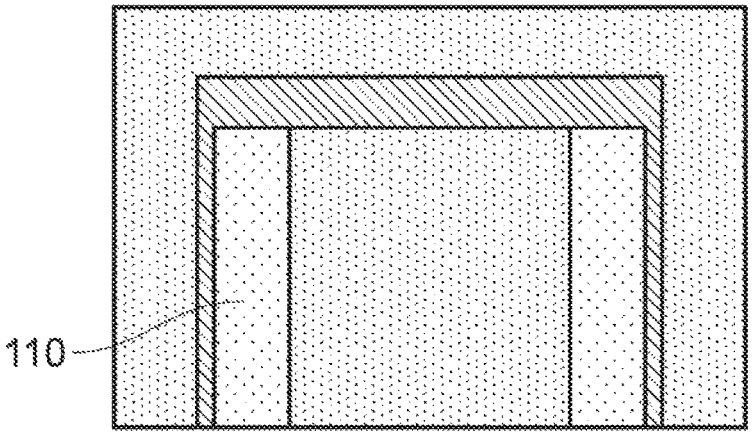

At step S3, the plenum void 100 is filled with a plenum void material 110, as shown in FIG. 2D.

Figure 2E:
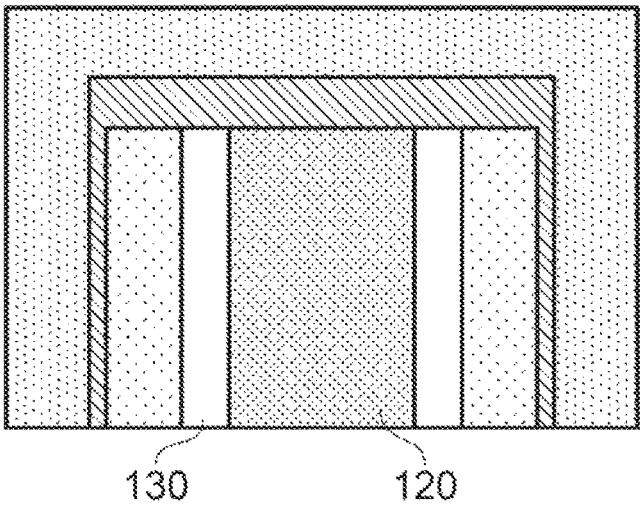

At step S4, the mould is reconfigured once more and processing returns to step S3. As shown in FIG. 2E, the second core 90 is removed and a third core 120 is inserted in its place. The third core 120 is of a smaller diameter than the second core 90 and defines a burner sleeve void 130.

Figure 2F:
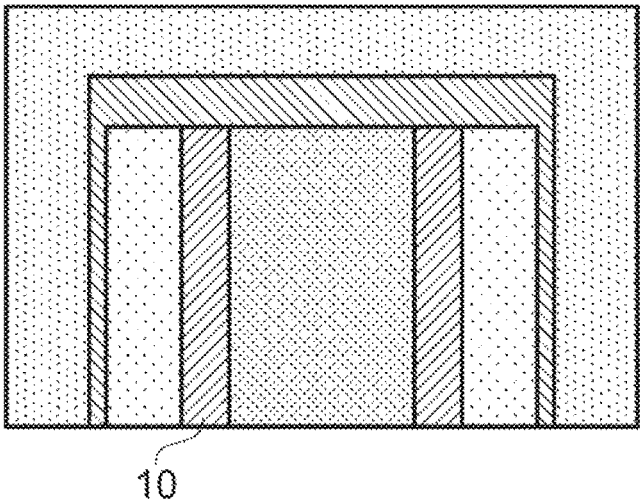

The second charge is injected into the burner sleeve void 130 to form the burner sleeve 10, as illustrated in FIG. 2F.

Figure 2G:
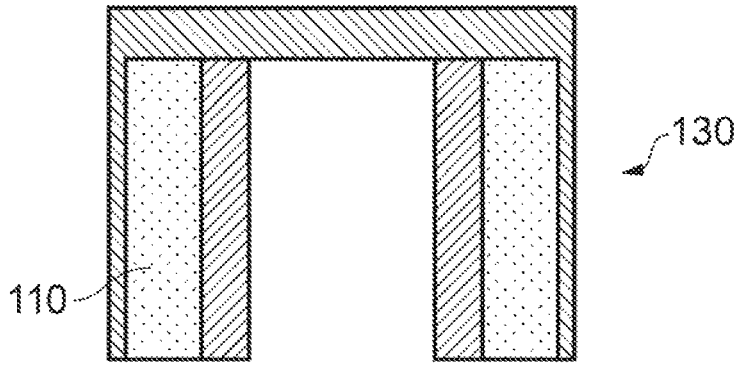

Processing then proceeds to step S5 where breakout occurs and the moulded burner element 130 is removed from the mould, as illustrated in FIG. 2G.

Figure 2H:
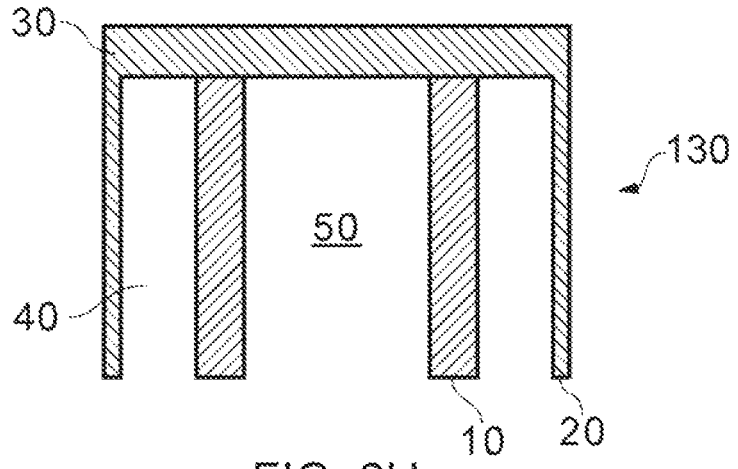

Processing then proceeds to step S6, where the plenum void material 110 is removed, as shown in FIG. 2H.

Processing then proceeds to step S6 where de-binding occurs and the flow compound is removed from the burner element, typically by heating to above the flow temperature of the flow compound. The temperature is then typically increased to remove the porogen from the burner sleeve 10. Once both the flow compound and the porogen have been removed then processing proceeds to step S7.

At step S7, the burner element is then sintered by raising the temperature to the sinter temperatures of the burner sleeve 10 and the outer housing 20.

Typically, the first charge used to create the outer housing 20 and the end plate 30 will have no porogen present in order to create a non-porous outer housing 20 and end plate 30. The second charge used to create the burner sleeve 10 has a porogen present typically within the sizes and ratios set out above in order to provide a porous burner sleeve 10. In some embodiments, the second charge used to create the burner sleeve 10 has a variable amount of porogen present typically selected from the sizes and ratios set out above in order to provide a graded or variable porosity along its axial length. In particular, the second charge may be delivered initially with a first amount of porogen, but the amount of porogen is changed as the second charge is delivered in order to create the burner sleeve 10 with differing porosities. In some embodiments, the burner sleeve 10 is formed from a plurality of different charges, each of which has a different amount of porogen present typically selected from the sizes and ratios set out above in order to provide a different porosity at different positions along its axial length. In particular, a first of the plurality of charges may be delivered with a first amount of porogen, a second of the plurality of charges may be delivered with a second amount of porogen, and so on, in order to build up the burner sleeve 10 with different porosities at different positions. In some embodiments, other charges can also used to create other porous and non-porous structures. It will be appreciated that the different ratios of porogen can be provided by changing the amount of porogen added to a charge by a single moulding station or by moving the mould to different moulding stations, each preconfigured to deliver a different charge with a different preselected amount of porogen.

Although this embodiment envisages a cylindrical combustion chamber housed within a cylindrical outer housing, it will be appreciated that other arrangements are envisage, such as flared or conical arrangements, bell-shaped, wedge-shaped or pyramidal burner sleeves which may or may not be enclosed by a similar or differing shaped outer housing.

The flow compound is typically removed by heating, although other compounds are possible which may be removed by a solvent. Likewise, the porogen is typically removed by heating, but these may also be removed instead by a solvent. The void materials may also be removed by heating but can also be removed by a solvent. It will be appreciated that the properties of the flow compounds, the porogen and any void materials will need to be selected to ensure that they are not affected during subsequent injection procedures and are unaffected by any different de-binding stages required to reveal the moulded burner element. Although in this embodiment the de-binding and sintering takes place outside of the mould, it will be appreciated that these may be performed with the moulded burner element still either wholly or at least partially retained within the mould. In another embodiment, a perforated liner (not shown) is inserted during processing at FIG. 2E into the burner sleeve void 130 to abut against the inner surface of the plenum void material 100. The perforations in the support liner are typically selected to assist in flow control of fuel from the plenum 40 into the burner sleeve 10.

Embodiments provide a method of producing a one-piece radiant burner comprising a porous sintered metal part fused to a non-porous housing, with a hollow "plenum" space in between utilising metal injection moulding techniques. This may be of any shape and is particularly advantageous for complex shapes. The porous metal shape is formed by injection moulding of a material that when heated/de-bindered forms a shape of controlled porosity in green (unsintered) form that can be sintered to give the desired product. The formulation for injection moulding may comprise metal powder, metal fibres, organic binder/wax and a porogen. The porogen typically needs to remain intact at injection moulding temperatures but be removed during the subsequent debindering/sintering. The porogen may be formed of hollow glass beads or a water-soluble wax or PMMA. The porosity should typically be around 80%. The porous metal may have a formulation akin to Fecralloy or 314 stainless steel. The cavity of the plenum likewise needs to be formed via a core of material that will withstand the injection moulding temperature. Water soluble wax could also be used. The non-porous metal typically needs to be formulated to include a binder with a lower melting point than the core and porogen materials. The metal when fused may be 304 or 316 stainless steel. Ideally the porous and non-porous materials should typically be chosen to have the same sintering temperature, recognising that the porous material needs to have high temperature oxidation resistance for use as a radiant burner. The injection mould tool will typically be designed with moveable "gates" allowing the non-porous metal to be injected against one face of the plenum wax core and the porous metal to be injected against the second face of the wax before the complete part is ejected from the tool.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A method of fabricating a burner element for an abatement apparatus, comprising:

multi-shot injection moulding comprising injection moulding a first charge having a metal powder and a flow compound and a second charge having metal particles, a flow compound and porogen into a mould defining said burner element to produce a moulded burner element wherein said injection moulding of one of said first charge and said second charge generates surface features shaped to enhance mechanical bonding between said first charge and said second charge; and sintering said moulded burner element.

2. The method of claim 1, comprising debinding said moulded burner element to allow at least one of the flow compounds to escape from said moulded burner element prior to sintering.

3. The method of claim 1, comprising debinding said moulded burner element to allow said porogen to escape from said moulded burner element prior to sintering.

4. The method of claim 1, wherein said second charge comprises around 5% to 10% by volume of said flow compound, around 15% to 20% by volume of said metal particles with the balance being said porogen.

5. The method of claim 1, wherein said second charge comprises said porogen selected to have at least one of a melting temperature which is higher than that of said flow compound of the second charge and a melting temperature which is less than a sintering temperature of said metal particles.

6. The method of claim 1, wherein said first charge comprises around 5% to 10% by volume of said flow compound with the balance being said metal powder.

7. The method of claim 1, wherein each shot has differing amounts of porogen to provide differing porosities for different structures forming said burner element.

8. The method of claim 7, wherein said differing amounts of porogen are provided by different shots, each of which has a different ratio of porogen to metal particles and/or by varying a ratio of porogen to metal particles within a shot.

9. The method of claim 1, wherein said metal particles comprise metal fibres.

10. The method of claim 9, wherein said metal powder and said metal fibres have an overlapping sintering temperature range.

11. The method of claim 1, wherein at least one surface of said mould comprises a removable perforated layer which forms part of said moulded burner element.

12. The method of claim 9, wherein at least one of said metal fibres and said metal powder comprise at least one of FeCr alloy and stainless steel.

13. The method of claim 1, wherein at least one of the flow compounds comprises at least one of an organic and a polymeric compound.

14. The method of claim 1, wherein said porogen comprises at least one of glass beads, an organic compound and a polymeric compound.

15. The method of claim 1, wherein said porogen has a particle size of between around 0.5 mm to 2 mm, and/or is provided in a ratio of between around 75% to 95% porogen with the balance being said metal particles.

16. The method of claim 9, wherein said metal fibres have a diameter of between around 0.05 mm to 0.25 mm, and/or wherein said metal powder has a particle size of around 0.0005 mm to 0.0025 mm.

17. A method of fabricating a burner element for an abatement apparatus, comprising:

multi-shot injection moulding comprising injection moulding a first charge having a metal powder and a flow compound and a second charge having metal particles, a flow compound and porogen into a mould defining said burner element to produce a moulded burner element wherein said first charge and said second charge are at least partially separated by a void material defining a void between said first charge and said second charge; and sintering said moulded burner element.

* * * * *